US008502746B2

(12) United States Patent
Huang

(10) Patent No.: US 8,502,746 B2
(45) Date of Patent: Aug. 6, 2013

(54) PLANAR DIRECTIONAL ANTENNA

(75) Inventor: Huan-Chu Huang, Taoyuan County (TW)

(73) Assignee: HTC Corporation, Taoyuan County (TW)

( * ) Notice: Subject to any disclaimer, the term of this patent is extended or adjusted under 35 U.S.C. 154(b) by 487 days.

(21) Appl. No.: 12/618,795

(22) Filed: Nov. 16, 2009

(65) Prior Publication Data

US 2011/0063187 A1 Mar. 17, 2011

(30) Foreign Application Priority Data

Sep. 14, 2009 (TW) ..... 98130911 A

(51) Int. Cl.
*H01Q 19/30* (2006.01)
*H01Q 19/00* (2006.01)
*H01Q 19/12* (2006.01)

(52) U.S. Cl.
USPC ..... 343/819; 343/833; 343/840

(58) Field of Classification Search
USPC ..... 343/700 MS, 793, 818, 819, 833, 343/834, 840, 846
See application file for complete search history.

(56) References Cited

U.S. PATENT DOCUMENTS

| | | | | |
|---|---|---|---|---|
| 6,046,703 | A * | 4/2000 | Wang et al. | 343/795 |
| 6,567,055 | B1 * | 5/2003 | Oglesby | 343/795 |
| 2006/0061513 | A1 * | 3/2006 | Sato | 343/767 |
| 2009/0079653 | A1 * | 3/2009 | Semonov et al. | 343/793 |

FOREIGN PATENT DOCUMENTS

WO 2009038739 3/2009

OTHER PUBLICATIONS

"Search Report of European Counterpart Application" issued on Jan. 27, 2010, p. 1-p. 4.

* cited by examiner

*Primary Examiner* — Robert Karacsony
(74) *Attorney, Agent, or Firm* — Jianq Chyun IP Office

(57) ABSTRACT

A planar directional antenna including a substrate, a metal layer, a master antenna, and an auxiliary antenna is provided. The substrate has a first surface and a second surface. The metal layer is disposed on the second surface of the substrate, and an upper edge of the metal layer forms a concave parabolic curve. The master antenna is disposed on the substrate and located within a predetermined range of the focus of the concave parabolic curve. The auxiliary antenna is disposed on the substrate and opposite to the master antenna so that the planar directional antenna generates a beam toward a radiation direction.

9 Claims, 6 Drawing Sheets

PLANAR DIRECTIONAL ANTENNA

CROSS-REFERENCE TO RELATED APPLICATION

This application claims the priority benefit of Taiwan application serial No. 98130911, filed on Sep. 14, 2009. The entirety of the above-mentioned patent application is hereby incorporated by reference herein and made a part of this specification.

BACKGROUND OF THE INVENTION

1. Field of the Invention

The present invention generally relates to an antenna, and more particularly, to a planar directional antenna.

2. Description of Related Art

An antenna is one of the most indispensable elements in a wireless communication system and which plays an important role in the performance of the entire system. Generally speaking, antennas can be categorized into isotropic antennas, omnidirectional antennas, and directional antennas according to their directivities. A directional antenna transmits and receives electromagnetic signals in a specific direction therefore can be broadly applied to point-to-point communication stations, or devices with the GPS (global positioning system) function, such as smart phones, personal digital assistants (PDAs), GPS navigators, or notebook computers, etc.

The reconfigurable antennas or smart antennas can replace the conventional directional antennas in actual applications. However, a reconfigurable antenna or a smart antenna usually has multiple antenna elements and requires a relatively complicated and enormous feed and distribution network and switches. Thus, a reconfigurable antenna or a smart antenna usually has higher cost and occupies larger surface area and volume. In addition, because a reconfigurable antenna or a smart antenna needs to interact with a decision-making chip along with the change of the external environment and accordingly adjusts the electrical parameters thereof, it is very complicated to implement a system with the conventional reconfigurable antenna or smart antenna.

Thereby, how to design a directional antenna that has a small volume, a high directivity, and a high applicability has become one of the major subjects in the industry.

SUMMARY OF THE INVENTION

Accordingly, the present invention is directed to a planar directional antenna, wherein a directional beam is generated through the coupling effect between a master antenna and an auxiliary antenna, and the directivity of the planar directional antenna is improved by adopting a metal layer with a concave parabolic curve.

The present invention provides a planar directional antenna including a substrate, a metal layer, a master antenna, and an auxiliary antenna. The substrate has a first surface and a second surface. The metal layer is disposed on the second surface of the substrate, and an upper edge of the metal layer forms a concave parabolic curve. The master antenna is disposed on the substrate and located within a predetermined range of the focus of the concave parabolic curve. The auxiliary antenna is disposed on the substrate and opposite to the master antenna so that the planar directional antenna generates a beam toward a radiation direction.

According to an embodiment of the present invention, the master antenna includes a first driving element and a second driving element. The first driving element is disposed on the first surface of the substrate. The second driving element is disposed on the second surface of the substrate and extended out of the metal layer. The first driving element and the second driving element respectively have a first arm and a second arm. The first arms of the first driving element and the second driving element overlap each other on a vertical projection plane, and the second arms of the first driving element and the second driving element are symmetrical to the radiation direction.

According to an embodiment of the present invention, the auxiliary antenna is disposed on the first surface of the substrate and opposite to the second arm of the first driving element. Besides, the auxiliary antenna is symmetrical to the radiation direction.

According to an embodiment of the present invention, the planar directional antenna further includes a first reflecting element and a second reflecting element, wherein the first reflecting element and the second reflecting element are disposed on the first surface of the substrate and arranged at both sides of the first arm of the first driving element. Besides, the first reflecting element and the second reflecting element surround the upper edge of the metal layer on the vertical projection plane.

As described above, in the present invention, a beam toward a specific radiation direction is generated through the dragging effect by the auxiliary antenna on the radiated power from the master antenna. In addition, the master antenna is disposed around the focus of a concave parabolic curve presented by the upper edge of a metal layer so that the directivity and front-to-back ratio (F/B) of the planar directional antenna can be effectively improved. Moreover, the planar directional antenna provided by the present invention reduces the complexity and volume in system implementation of an electronic device and offers reduced surface area and volume.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
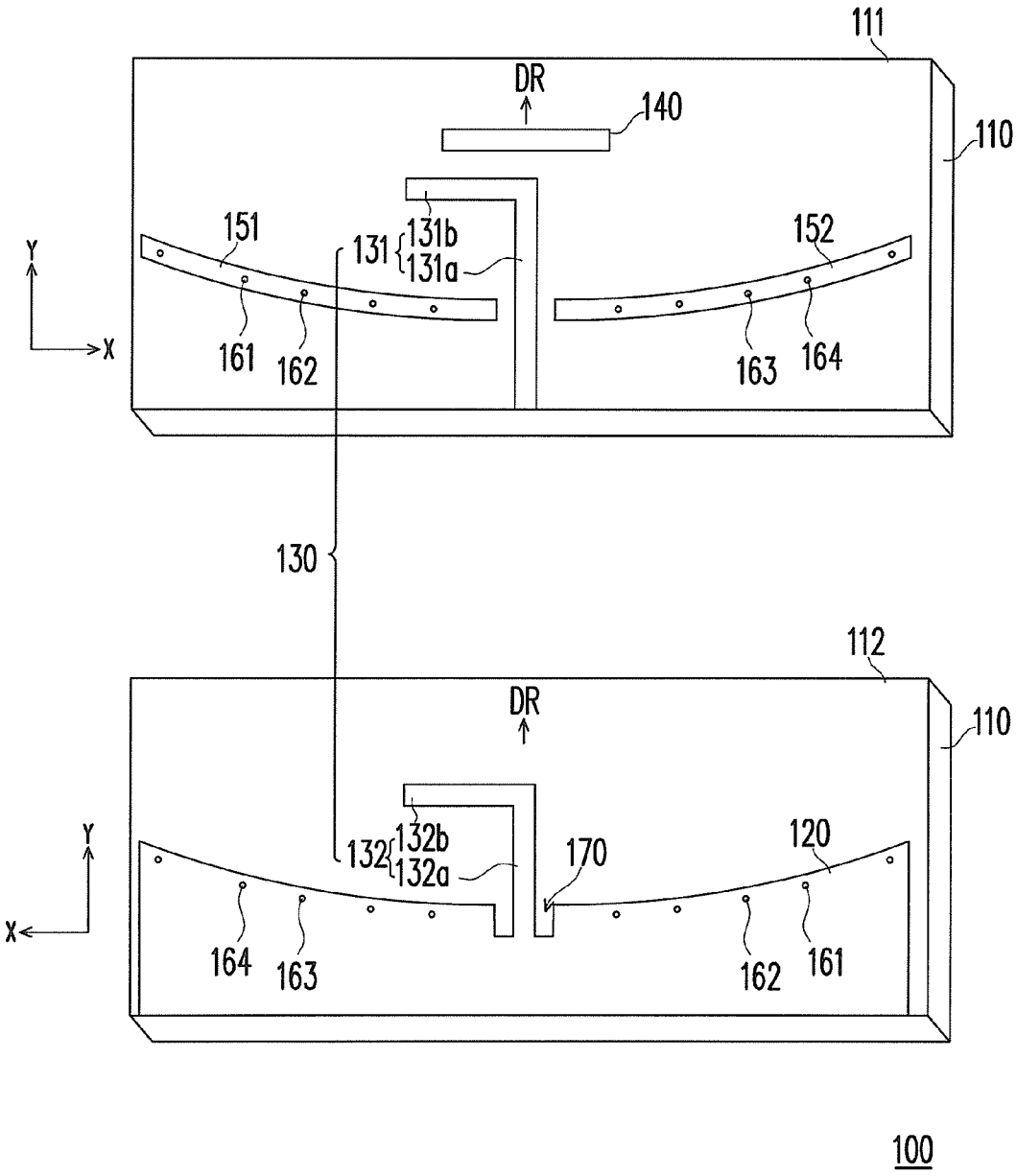
FIG. 1 is a layout diagram of a planar directional antenna according to an embodiment of the present invention.

Reference will now be made in detail to the present preferred embodiments of the invention, examples of which are illustrated in the accompanying drawings. Wherever possible, the same reference numbers are used in the drawings and the description to refer to the same or like parts.

FIG. 1 is a layout diagram of a planar directional antenna according to an embodiment of the present invention. Referring to FIG. 1, the planar directional antenna 100 includes a substrate 110, a metal layer 120, a master antenna 130, and an auxiliary antenna 140. The substrate 110 has a first surface 111 (i.e., the plane foamed by the axis X and the axis Y, as the upper portion illustrated in FIG. 1) and a second surface 112 (i.e., the plane formed by the axis +X and the axis +Y, as the lower portion illustrated in FIG. 1).

Figure 3:
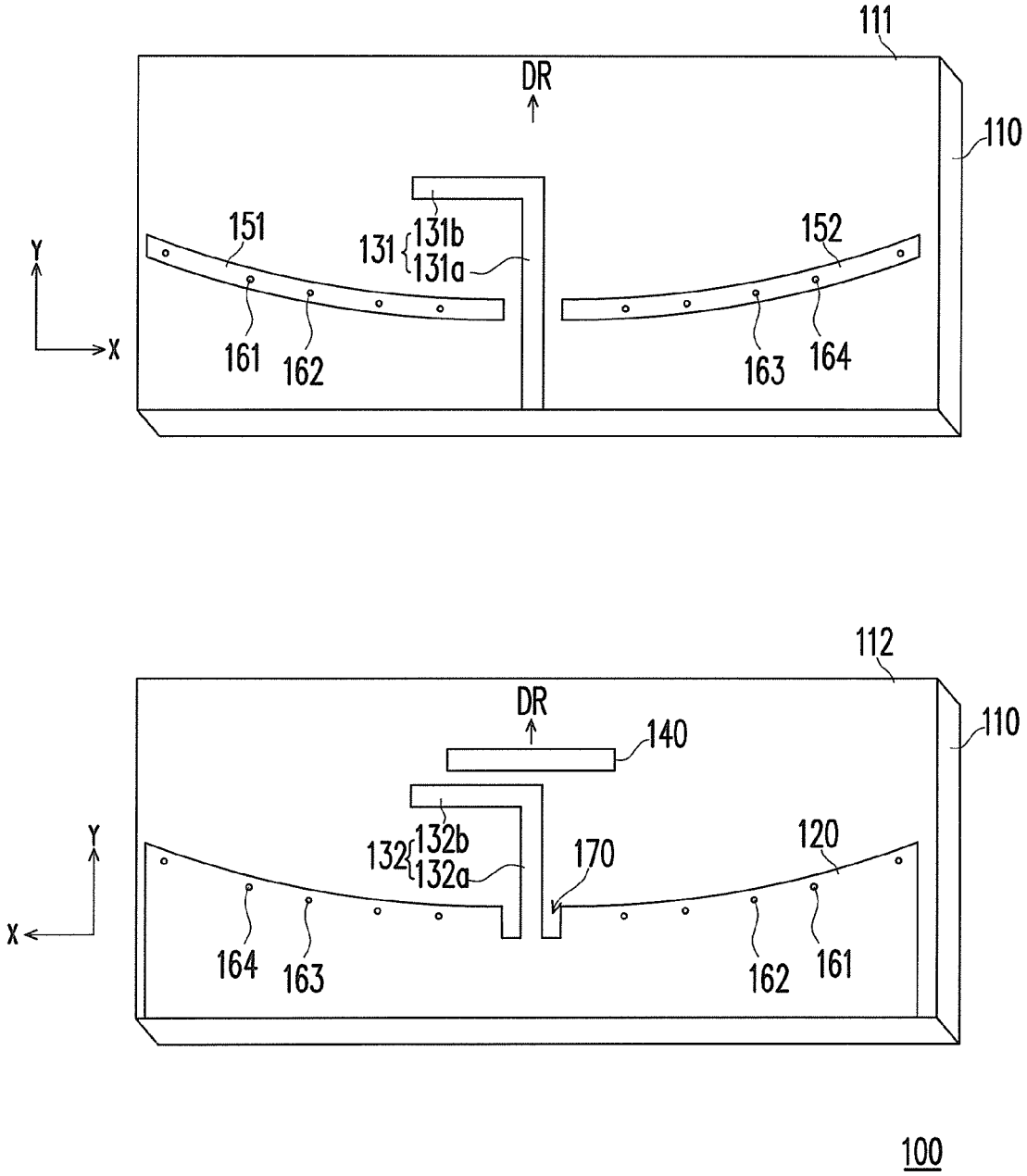
FIG. 3 is a layout diagram of a planar directional antenna according to another embodiment of the present invention.
Figure 4:
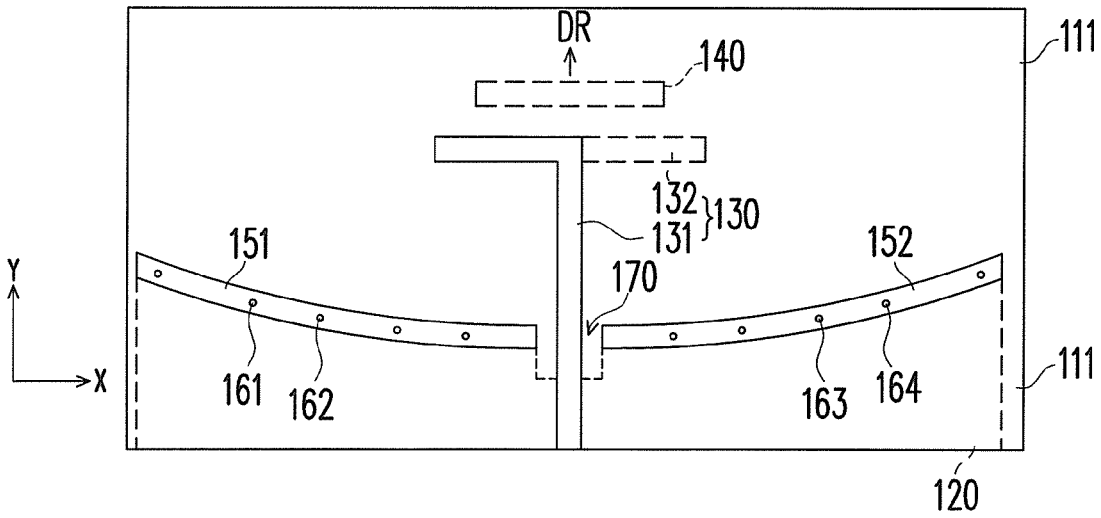
FIG. 4 is a perspective diagram of the planar directional antenna in FIG. 3 on a vertical projection plane.

Referring to FIG. 1, the master antenna 130 includes a first driving element 131 and a second driving element 132. The first driving element 131 and the auxiliary antenna 140 are both disposed on the first surface 111 of the substrate 110, and the second driving element 132 and the metal layer 120 are both disposed on the second surface 112 of the substrate 110. Referring to FIG. 3 and FIG. 4, in another embodiment of the present invention, only the first driving element 131 is disposed on the first surface 111 of the substrate 110, and the second driving element 132, the auxiliary antenna 140, and the metal layer 120 are disposed on the second surface 112 of the substrate 110. The master antenna 130 may be a dipole antenna in actual applications, and the master antenna 130 is hence described as a dipole antenna in the present embodiment. The first driving element 131 and the second driving element 132 of the master antenna 130 respectively present an L shape and respectively have two arms. For example, the first driving element 131 has a first arm 131*a* and a second arm 131*b*, and the second driving element 132 has a first arm 132*a* and a second arm 132*b*. It should be mentioned that the first arm 131*a* of the first driving element 131 is connected to a feed point (not shown), and the metal layer 120 can be considered a portion of the system ground plane.

Figure 2:
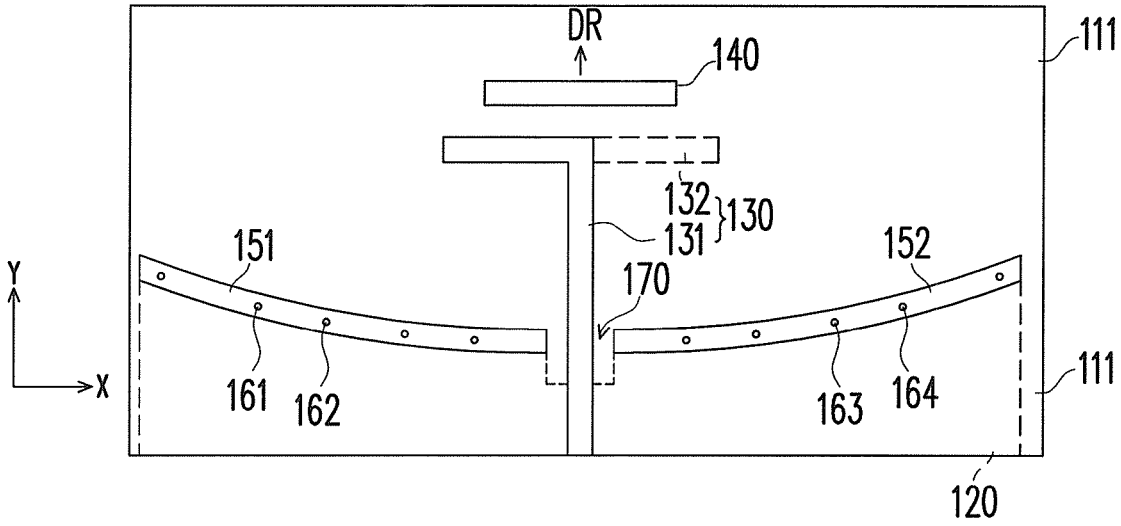
FIG. 2 is a perspective diagram of the planar directional antenna in FIG. 1 on a vertical projection plane.

For the convenience of description, an embodiment of the present invention will be described in detail with reference to the structure illustrated in FIG. 1 and FIG. 2, and the content illustrated in FIG. 3 and FIG. 4 will not be described herein. However, those skilled in the art should be able to implement the embodiment illustrated in FIG. 3 and FIG. 4 according to the present disclosure. FIG. 2 is a diagram illustrating the perspective structure of the planar directional antenna in FIG. 1 on a vertical projection plane, wherein the relative positions of the second driving element 132 and the metal layer 120 vertically projected onto the first surface 111 are denoted with doted lines. Referring to both FIG. 1 and FIG. 2, the spatial relation between the second driving element 132 and the second surface 112 is expressed with the axis +X and the axis +Y, and the spatial relation between the first driving element 131 and the first surface 111 are also expressed with the axis X and the axis Y. Thus, when the second driving element 132 is vertically projected on the first surface 111, as shown in FIG. 2, by looking down at the first surface 111 (i.e., the plane formed by the axis X and the axis Y), the first arm 131*a* of the first driving element 131 and the first arm 132*a* of the second driving element 132 overlap each other on the vertical projection plane, and the second arm 131*b* of the first driving element 131 and the second arm 132*b* of the second driving element 132 are symmetrical to a radiation direction DR (i.e., the axis Y).

According to the dispositions of the first driving element 131 and the second driving element 132, the master antenna 130 radiates the maximum power toward the radiation direction DR. Besides, the auxiliary antenna 140 is opposite to the second arm 131*b* of the first driving element 131 and symmetrical to the radiation direction DR, wherein the length of the auxiliary antenna 140 is shorter than the total length of the second arm 131*b* of the first driving element 131 and the second arm 132*b* of the second driving element 132. Accordingly, the auxiliary antenna 140 produce a dragging effect on the radiated power from the master antenna 130 such that the power radiated is focused in the radiation direction DR and a beam toward the radiation direction DR is generated.

It should be noted that in order to further focus the beam generated by the planar directional antenna 100 or direct it toward the radiation direction DR, the metal layer 120 is disposed for reflecting the power radiated by the master antenna 130. Regarding the actual disposition, the metal layer 120 has an upper edge, two side edges, and a bottom edge by looking down at the second surface 112 (i.e., the plane formed by the axis +X and the axis +Y) of the substrate 110. In the present embodiment, the upper edge of the metal layer 120 forms a concave parabolic curve so as to improve the directivity and front-to-back ratio (F/B) of the planar directional antenna 100. Namely, the upper edge of the metal layer 120 is concaved toward the reverse direction of the radiation direction DR (i.e., the direction of the axis −Y), and the concave curve presents a parabolic shape. The concave parabolic curve defines a focus and a directrix such that any point on the concave parabolic curve is at the same distance away from the focus and the directrix.

Because of the characteristic of the concave parabolic curve, as shown in FIG. 2, the extensions of the first arm 131*a* of the first driving element 131 and the first arm 132*a* of the second driving element 132 are perpendicular to the directrix (i.e., the axis X) of the concave parabolic curve, and the first driving element 131 and the second driving element 132 are located around the focus of the concave parabolic curve. The electromagnetic power radiated toward the reverse direction of the radiation direction DR (the direction of the axis −Y) is more focused in the radiation direction DR after they are reflected by the metal layer 120, and the beam generated by the planar directional antenna 100 is more focused or has a higher directivity and lower front-to-back ratio (F/B).

Figure 5:
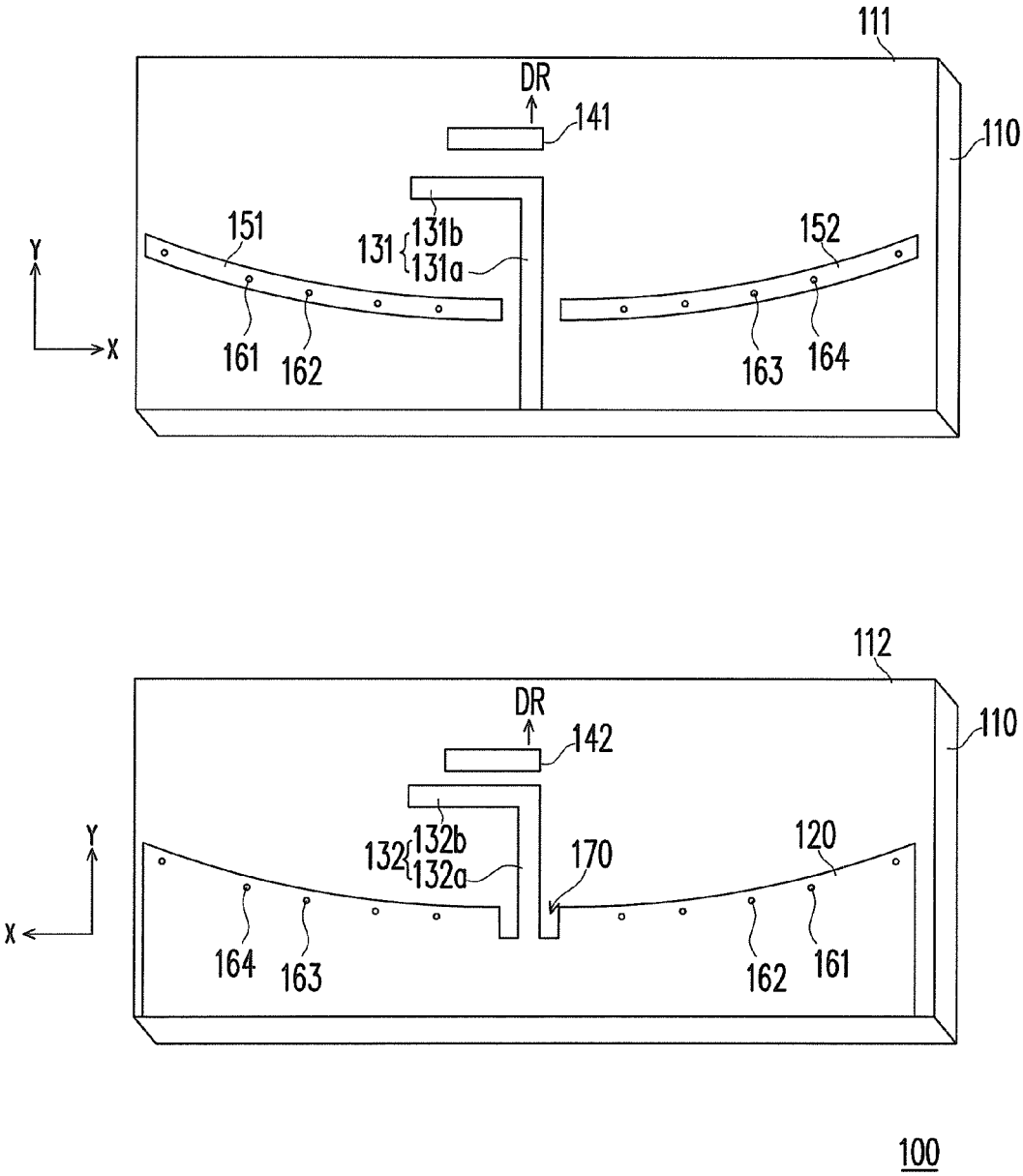
FIG. 5 is a layout diagram of a planar directional antenna according to yet another embodiment of the present invention.
Figure 6:
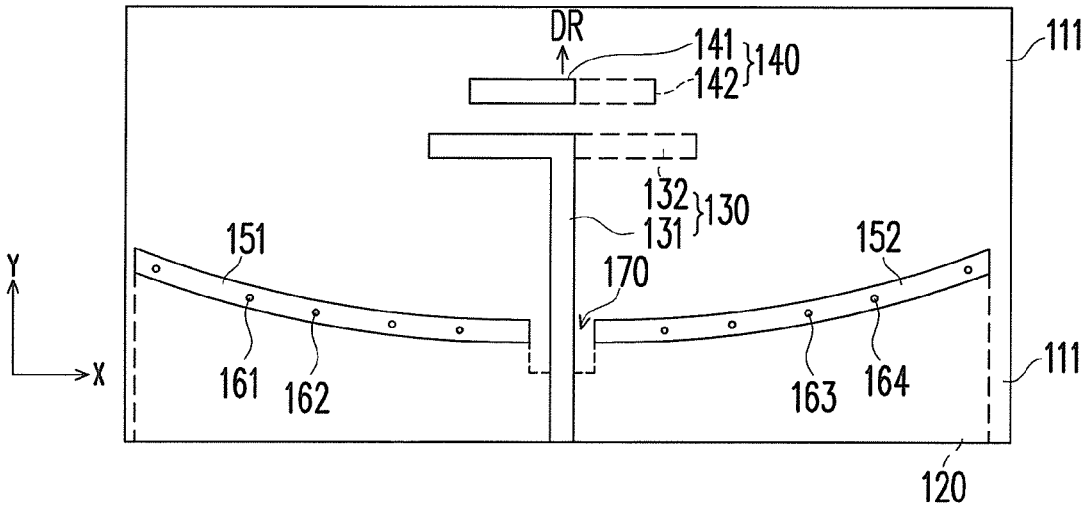
FIG. 6 is a perspective diagram of the planar directional antenna in FIG. 5 on a vertical projection plane.

Referring to FIG. 5 and FIG. 6, in the planar directional antenna 100 illustrated in FIG. 5 and FIG. 6 according to another embodiment of the present invention, the auxiliary antenna 140 is divided into a sub auxiliary antenna 141 and a sub auxiliary antenna 142. The sub auxiliary antenna 141 and the first driving element 131 are disposed on the first surface 111 of the substrate 110, and the sub auxiliary antenna 142, the second driving element 132, and the metal layer 120 are disposed on the second surface 112 of the substrate 110. Besides, the sub auxiliary antenna 141 is opposite to the second arm 131*b* of the first driving element 131, and the sub auxiliary antenna 142 is opposite to the second arm 132*b* of the second driving element 132. In addition, the total length of the sub auxiliary antenna 141 and the sub auxiliary antenna 142 is shorter than the total length of the second arm 131*b* of the first driving element 131 and the second arm 132*b* of the second driving element 132. The dispositions, structures, and shapes of other elements besides the auxiliary antenna 140 in FIG. 5 and FIG. 6 are the same as those described in foregoing embodiments therefore will not be described herein.

As shown in FIG. 6, the relative position between the sub auxiliary antenna 141 and the sub auxiliary antenna 142 on a vertical projection plane is corresponding to the relative position between the second a 131*b* of the first driving element 131 and the second arm 132*b* of the second driving element 132 on the vertical projection plane. Thus, in actual applications, the auxiliary antenna 140 composed of the sub auxiliary antenna 141 and the sub auxiliary antenna 142 also produces a dragging effect on the radiated power from the master antenna 130. Accordingly, the power radiated by the master antenna 130 is focused in the radiation direction DR so that a beam towards the radiation direction DR is generated. By taking the directivity and back-radiation into consideration, the sub auxiliary antenna 141 and the sub auxiliary antenna 142 may be electrically connected with each other through a via (not shown). In addition, the beam generated by the planar directional antenna 100 is more focused or has a higher directivity thanks to the concave parabolic curve presented by the upper edge of the metal layer 120.

For the convenience of description, an embodiment of the present invention will be described in detail with reference to the structure illustrated in FIG. 1 and FIG. 2, and the content illustrated in FIG. 5 and FIG. 6 will not be described herein. However, those skilled in the art should be able to implement the embodiment illustrated in FIG. 5 and FIG. 6 according to the present disclosure. Referring to FIG. 1 and FIG. 2 again, the transmission distance of the planar directional antenna 100 is increased along with the improvement of the directivity thereof. Accordingly, the planar directional antenna 100 can be broadly applied to the GPS functions in different types of handheld electronic devices (for example, cell phones, notebook computers, global positioning system (GPS) navigators, ultra mobile PCs (UMPCs), network linkable notebooks (netbooks), and smartbooks, etc) and different types of directional base stations (for example, AGPS base stations), point-to-point communication stations, and smart base stations, etc). However, the possible applications of the planar directional antenna 100 mentioned in the present embodiment are not intended to limiting the present invention.

Additionally, because the planar directional antenna 100 has a flat structure, it can be directly disposed on the parts of a handheld electronic device (for example, the back cover of a cell phone or the cover a battery chamber) or directly laid out on a PCB substrate. Accordingly, the size of the handheld electronic device can be reduced. Moreover, when the planar directional antenna 100 is applied in a directional base station, the flat structure of the planar directional antenna 100 allows the volume of the base station to be reduced. Furthermore, since the planar directional antenna 100 has a very concise structure, system implementation of a handheld electronic device or a base station adopting the planar directional antenna 100 is made simpler and cheaper.

The planar directional antenna 100 may also be disposed with a metal layer 120 having a notch and additional reflecting elements and vias, so as to improve the characteristics of the antenna. For example, as shown in FIG. 1 and FIG. 2, the planar directional antenna 100 further includes a first reflecting element 151, a second reflecting element 152, and a plurality of vias 161~164, and the upper edge of the metal layer 120 has a notch 170. The first arm 132*a* of the second driving element 132 is extended from the metal layer where the notch 170 is located at toward the radiation direction DR, and the first arm 132*a* of the second driving element 132 is disposed at the center of the notch 170, so as to increase the degree of impedance matching for the master antenna 130.

In addition, the first reflecting element 151 and the second reflecting element 152 are disposed on the first surface 111 of the substrate 110 and arranged at both sides of the first arm 131*a* of the first driving element 131. In the present embodiment, the first reflecting element 151 and the second reflecting element 152 present a strip shape. Besides, when the first reflecting element 151 and the second reflecting element 152 are vertically projected onto the second surface 112 of the substrate 110, the projections of the first reflecting element 151 and the second reflecting element 152 surround the upper edge of the metal layer 120. Since the upper edge of the metal layer 120 presents a concave parabolic curve, the first reflecting element 151 and the second reflecting element 152 also present a concave curve along the upper edge of the metal layer 120. Accordingly, the first reflecting element 151 and the second reflecting element 152 further improve the directivity and the front-to-back ratio (F/B) of the planar directional antenna 100.

It should be noted that the first reflecting element 151 and the second reflecting element 152 mainly reflect the power radiated by the first driving element 131 on the first surface 111, and the metal layer 120 mainly reflects the power radiated by the second driving element 132 on the second surface 112. However, the radiation of power is in all directions and difficult to control. Thus, the power from the first surface 111 is also radiated toward the second surface 112 through the substrate 110, and the power from the second surface 112 is also radiated toward the first surface 111 through the substrate 110. Herein, the electromagnetic power radiated toward the reverse direction of the radiation direction DR (i.e., the direction of the axis −Y) through the substrate 110 is also reflected by the first reflecting element 151, the second reflecting element 152, and the metal layer 120. Namely, the first reflecting element 151 and the second reflecting element 152 may also reflect the power from the second surface 112, and the metal layer 120 may also reflect the power from the first surface 111.

Additionally, in order to completely reflect the electromagnetic power radiated toward the reverse direction of the radiation direction DR through the substrate 110, in the present embodiment, the vias 161~164 are disposed to further improve the directivity and the front-to-back ratio (F/B) of the planar directional antenna 100. The vias 161~164 pass through the metal layer 120, the substrate 110, and the first reflecting element 151 or pass through the metal layer 120, the substrate 110, and the second reflecting element 152. The first reflecting element 151 and the second reflecting element 152 are electrically connected to the metal layer 120 through the vias 161~164.

Thereby, the vias 161~164 have the same function as the reflecting elements 151~152 and the metal layer 120 and accordingly can reflect part of the power passing through the substrate 110. Accordingly, the directivity and the front-to-back ratio (F/B) of the planar directional antenna 100 are further improved. Even though four vias are described in the present embodiment, the present invention is not limited thereto, and the number of the vias can be adjusted by those having ordinary knowledge in the art according to the design requirement of the antenna design by taking the cost into consideration. The relative positions of these vias can also be arranged by those having ordinary knowledge in the art.

As described above, in the present invention, a beam toward a specific radiation direction is generated through the power dragging effect between a master antenna and an auxiliary antenna. In addition, the master antenna is disposed around the focus of a concave parabolic curve presented by an upper edge of a metal layer. Thus, electromagnetic power radiated toward the reverse direction of the radiation direction is more focused in the specific radiation direction after they are reflected by the metal layer, and the beam generated by the planar directional antenna is more focused or has a higher directivity and low front-to-back ratio (F/B). Moreover, the planar directional antenna provided by the present invention has reduced surface area and volume, and it helps to reduce the complexity and volume in system implementation of an electronic device.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A planar directional antenna, comprising:

a substrate, having a first surface and a second surface;

a metal layer, disposed on the second surface, wherein an upper edge of the metal layer forms a concave parabolic curve which reflects and focuses radiation;

a dipole master antenna, disposed on the substrate, located within a predetermined range of a focus of the concave parabolic curve and connected to a feed point, and comprising a first driving element, disposed on the first surface of the substrate, having a first arm and a second arm; and a second driving element, disposed on the second surface of the substrate and extended directly out of the metal layer, having a first arm and a second arm, wherein the first arms of the first driving element and the second driving element overlap each other on a vertical projection plane, and the second arms of the first driving element and the second driving element are symmetrical to the radiation direction; and an auxiliary antenna, disposed on the substrate and opposite to the master antenna so that the planar directional antenna generates a beam toward a radiation direction.

2. The planar directional antenna according to claim 1, wherein the auxiliary antenna is disposed on the first surface of the substrate and opposite to the second arm of the first driving element and is symmetrical to the radiation direction.

3. The planar directional antenna according to claim 1, wherein a total length of the second arm of the first driving element and the second arm of the second driving element is longer than a length of the auxiliary antenna.

4. The planar directional antenna according to claim 1, wherein the upper edge of the metal layer comprises a notch to increase impedance matching for the dipole master antenna, the first arm of the second driving element is extended from the metal layer where the notch is located toward the radiation direction, and the first arm of the second driving element is disposed at a center of the notch.

5. The planar directional antenna according to claim 1 further comprising a first reflecting element and a second reflecting element, wherein the first reflecting element and the second reflecting element are disposed on the first surface of the substrate and arranged at both sides of the first arm of the first driving element, and the first reflecting element and the second reflecting element surround the upper edge of the metal layer on the vertical projection plane.

6. The planar directional antenna according to claim 5 further comprising a plurality of vias, wherein the vias pass through the metal layer, the substrate, and the first reflecting element or pass through the metal layer, the substrate, and the second reflecting element so that the first reflecting element or the second reflecting element is electrically connected to the metal layer.

7. The planar directional antenna according to claim 1, wherein the auxiliary antenna is disposed on the second surface of the substrate and opposite to the second arm of the second driving element and is symmetrical to the radiation direction.

8. The planar directional antenna according to claim 1, wherein the auxiliary antenna comprises:

a first sub auxiliary antenna, disposed on the first surface of the substrate and opposite to the second arm of the first driving element; and a second sub auxiliary antenna, disposed on the second surface of the substrate and opposite to the second arm of the second driving element.

9. The planar directional antenna according to claim 8, wherein the total length of the second arm of the first driving element and the second arm of the second driving element is longer than a total length of the first sub auxiliary antenna and the second sub auxiliary antenna.

* * * * *